US007111691B2

(12) United States Patent
Siltanen et al.

(10) Patent No.: US 7,111,691 B2
(45) Date of Patent: Sep. 26, 2006

(54) BREAKING HAMMER, AND FASTENING ELEMENT, SIDE PLATE, AND PROTECTIVE CASING OF BREAKING HAMMER

(75) Inventors: Olli Siltanen, Lahti (FI); Teemu Teelahti, Hirvensalmi (FI)

(73) Assignee: Sandvik Tamrock Oy, Tampere (FI)

( * ) Notice: Subject to any disclaimer, the term of this patent is extended or adjusted under 35 U.S.C. 154(b) by 0 days.

(21) Appl. No.: 11/170,007

(22) Filed: Jun. 30, 2005

(65) Prior Publication Data

US 2006/0000626 A1 Jan. 5, 2006

(30) Foreign Application Priority Data

Jul. 1, 2004 (FI) ..... 20040920

(51) Int. Cl.
*B25D 17/28* (2006.01)

(52) U.S. Cl. ..... 173/200; 173/90; 173/31

(58) Field of Classification Search ..... 173/200, 173/90, 171, 31, 36, 190, 162.2, 162.1
See application file for complete search history.

(56) References Cited

U.S. PATENT DOCUMENTS

| | | | | |
|---|---|---|---|---|
| 4,158,520 | A * | 6/1979 | Prebensen | 405/259.1 |
| 4,402,383 | A * | 9/1983 | Bailey | 181/202 |
| 4,480,955 | A * | 11/1984 | Andrews et al. | 414/723 |
| 4,506,744 | A * | 3/1985 | Dawson | 173/131 |
| 5,095,600 | A * | 3/1992 | Allan | 29/81.16 |
| 5,285,858 | A | 2/1994 | Okada et al. | |
| 5,350,250 | A * | 9/1994 | Nagler | 403/316 |
| 6,163,989 | A | 12/2000 | Kaczmarski et al. | |
| 6,227,307 | B1 * | 5/2001 | Lee | 173/78 |
| 6,336,785 | B1 * | 1/2002 | Kunzman | 414/723 |
| RE37,661 | E * | 4/2002 | Raunisto | 405/232 |
| 6,431,528 | B1 * | 8/2002 | Kojima | 261/79.2 |
| 6,539,650 | B1 * | 4/2003 | Kaczmarski et al. | 37/468 |
| 7,014,385 | B1 * | 3/2006 | Lim et al. | 403/322.4 |
| 2002/0000053 | A1 * | 1/2002 | Adamic et al. | 37/456 |

FOREIGN PATENT DOCUMENTS

| | | |
|---|---|---|
| EP | 0 534 369 A1 | 3/1993 |
| EP | 1 270 098 | 1/2003 |
| EP | 1 479 830 | 11/2004 |
| FI | 20010918 | 11/2002 |
| FR | 2 408 017 | 6/1979 |
| GB | 1 476 771 | 6/1977 |
| JP | 11-058263 A | 3/1999 |
| JP | 11-156757 A | 6/1999 |

* cited by examiner

*Primary Examiner*—Scott A. Smith
*Assistant Examiner*—Brian Nash
(74) *Attorney, Agent, or Firm*—Drinker Biddle & Reath LLP

(57) ABSTRACT

A crushing hammer, and a fastening element, side plate, and protective casing for the crushing hammer. The crushing hammer comprises at least two alternative fastening elements with which it can be fastened to a boom of a work machine. The fastening can be done with a separate fastening element that is equipped with a plane surface for flange mounting and openings for a pin mounting. The fastening elements may also be formed to side plates, between which the crushing hammer is arranged. The fastening elements may further be integrated to the protective casing.

10 Claims, 3 Drawing Sheets

BREAKING HAMMER, AND FASTENING ELEMENT, SIDE PLATE, AND PROTECTIVE CASING OF BREAKING HAMMER

BACKGROUND OF THE INVENTION

The invention relates to a breaking hammer comprising: a percussion device arranged to generate impact pulses to a tool connectable to the breaking device, and fastening means in the top part of the breaking hammer for fastening the breaking hammer to a work machine. The invention further relates to a fastening element, a side plate, and a protective casing of a breaking hammer.

A breaking hammer is used as an auxiliary device to an excavator or some other work machine when breaking rock, concrete or some other relatively hard material. The breaking hammer has a percussion device that strikes a tool fastened to the breaking hammer, which transmits the percussions on to the material to be broken. A percussion device is generally hydraulic and has a percussion piston that makes a reciprocating movement caused by hydraulic pressure and strikes an impact surface at the top end of the tool. As the percussion piston strikes, the tool is pressed against the material to be broken, whereby, due to the impact and pressing, the tool penetrates the material to be handled and breaks it. The breaking hammer is equipped with fastening means for fastening it to a boom of the work machine. There may, however, be booms of different type and they may be equipped with means of different type for fastening auxiliary devices. The breaking hammer must, therefore, be equipped with a fastening element suited for the boom in question. This is difficult, because breaking hammers then need to be manufactured with various fastening elements, which naturally increases manufacturing costs. Another drawback is that the breaking hammer is only suited for use in work machines employing the fastening system in question.

BRIEF DESCRIPTION OF THE INVENTION

It is an object of the present invention to provide a novel and improved breaking hammer, and a fastening element, side plate, and protective casing for fastening the breaking hammer.

The breaking hammer of the invention is characterized in that the breaking hammer comprises at least two alternative fastening means for fastening it to a work machine, the top part of the breaking hammer comprises at least one plane surface, against which a flange belonging to the work machine is arrangeable to form a flange mounting between the breaking hammer and work machine, and the top part of the breaking hammer comprises at least one opening, to which a connecting pin is arrangeable to form an alternative pin connection between the breaking hammer and work machine.

The fastening element of the invention is characterized in that the fastening element comprises: at least one first projection and at least one second projection arranged at a distance from each other with a substantially empty space between the first and second projections, at least one set of plane surfaces at the outermost parts of the projections, the plane surfaces forming means for a flange mounting between the breaking hammer and work machine, at least one first transverse opening in the first projection and the second projection, whereby a connection pin is arrangeable through the openings for a pin mounting between the breaking hammer and work machine, and a flange, against which a mounting face in the top part of the breaking hammer is arrangeable.

The side plate of the invention is characterized in that it has in its top part at least two alternative fastening means for fastening the breaking hammer to the work machine, the top part of the side plate comprises at least one plane surface, against which a flange belonging to the work machine is arrangeable to form a flange mounting between the breaking hammer and work machine, and the top part of the side plate comprises at least one opening, to which a connection pin is arrangeable to form an alternative pin mounting between the breaking hammer and work machine.

The protective casing of the invention is characterized in that the protective casing comprises -at least two alternative fastening means for fastening it to a work machine, the protective casing comprises at least one plane surface, against which a flange belonging to the work machine is arrangeable to form a flange mounting between the breaking hammer and work machine, and the protective casing comprises at least one opening, to which a connection pin is arrangeable to form an alternative pin mounting between the breaking hammer and work machine.

The essential idea of the invention is that the breaking hammer is equipped with at least two alternative fastening systems. The top part of the breaking hammer has at least one plane surface, against which a fastening flange in the boom or the like of the work machine can be arranged. This is provides a flange mounting between the breaking hammer and work machine. The top part of the breaking hammer further has at least one opening, to which a connection pin can be arranged to fasten the breaking hammer to the boom or the like of the work machine. This provides a pin mounting. The breaking hammer is, thus, arranged with alternative means at least for a flange mounting and a pin mounting.

The invention provides the advantage that it is no longer necessary to manufacture breaking hammers equipped with different fastening systems, because the breaking hammer of the invention can be fastened to the work machine in two or more alternative ways. This reduces the manufacturing costs. In addition, one and the same breaking hammer can, if necessary, be fastened to a work machine equipped with different fastening systems, whereby the breaking hammer can be utilized in a more flexible and efficient manner than before.

An essential idea of an embodiment of the invention is that the fastening means have at least one first projection and at least one second projection arranged at a distance from each other with a substantially empty space between the projections, to which the end of a boom or the like can be arranged if necessary. The outermost ends of the projections further have plane surfaces that can be utilized in a flange mounting between the breaking hammer and work machine. The work machine may have a fastening flange or some other fastening element for flange mounting. Both projections are also equipped with at least one transverse opening, through which a connection pin can be arranged to form a pin mounting between the breaking hammer and work machine.

An essential idea of an embodiment of the invention is that the fastening means are integrated to the structure of the breaking hammer. The fastening means may be formed on the body of the percussion device or on the protective casing surrounding the percussion device.

An essential idea of an embodiment of the invention is that the breaking hammer is fastened to the work machine with a separate fastening element. The fastening element has at least two alternative fastening means for fastening the breaking hammer to the work machine.

An essential idea of an embodiment of the invention is that the breaking hammer is arranged between two side plates that are equipped with fastening elements for fastening the breaking hammer to the work machine. The side plates have at least two alternative fastening elements for fastening the breaking hammer to the work machine.

BRIEF DESCRIPTION OF THE FIGURES

The invention will be described in greater detail by means of the attached drawings, in which.

In the figures, the invention is shown simplified for the sake of clarity. Similar parts are marked with the same reference numbers in the figures.

DETAILED DESCRIPTION OF SOME EMBODIMENTS OF THE INVENTION

Figure 1:
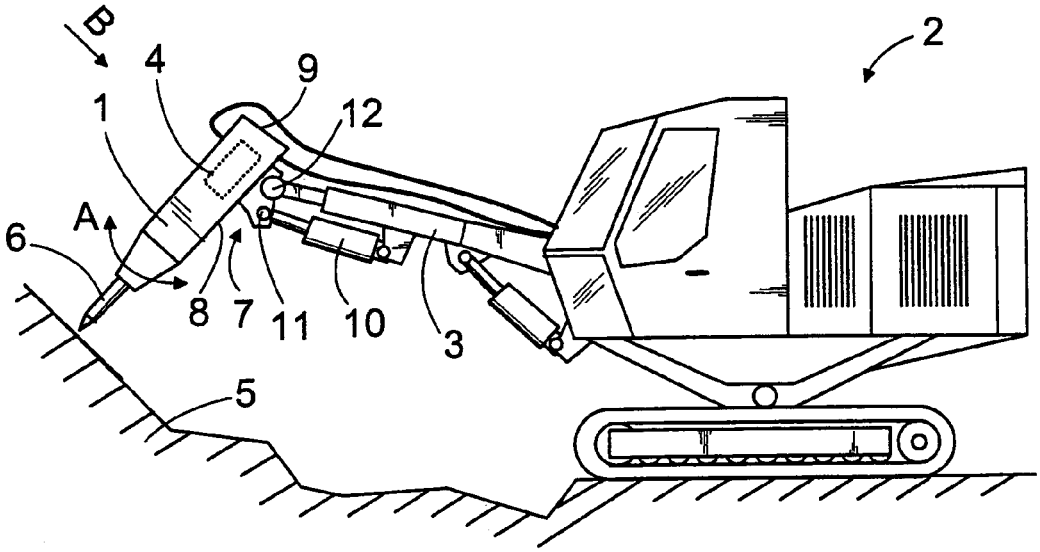
FIG. 1 is a schematic side view of a breaking hammer arranged on a boom of an excavator.

In FIG. 1, a breaking hammer 1 is arranged at the free end of an excavator 2 boom 3. The breaking hammer 1 can be arranged to any movable work machine or to a boom, for instance, that is mounted on a fixed platform. The breaking hammer 1 has a percussion device 4 for generating impact pulses. The breaking hammer 1 is pressed by means of the boom 3 against a material 5 to be broken as the percussion device 4 strikes a tool 6 connected to the breaking hammer 1, which transmits the impacts to the material 5 to be broken. The percussion device 4 of the breaking hammer 1 may be hydraulic, whereby it may be connected to the hydraulic system of the excavator 2. The percussion device 4 may also be of some other type, such as electric. The impact pulses may be generated in other ways than with a reciprocating percussion piston.

The breaking hammer 1 comprises a fastening element 7, by means of which it can be fastened to the outermost end of the boom 3. The fastening element 7 may be arranged to the side 8 or top end 9 of the breaking hammer 1. The fastening element 7 may be an integral part of the breaking hammer 1 or it may be a separate piece that is fastened to a protective casing surrounding the breaking hammer 1 or to the body of the breaking hammer. The breaking hammer 1 may be arranged to be turnable with respect to the boom 3. To turn the breaking hammer 1 in direction A, the boom may have a turning device 10, such as a hydraulic cylinder or a corresponding actuator that may be connected to the fastening element 7 with a turning pin 11 or the like. The outermost end of the boom 3 may further be connected to the fastening element by means of a connection pin 12, for instance. The connection pin 12 may act as an articulation, around which the breaking hammer can be turned.

Figure 2:
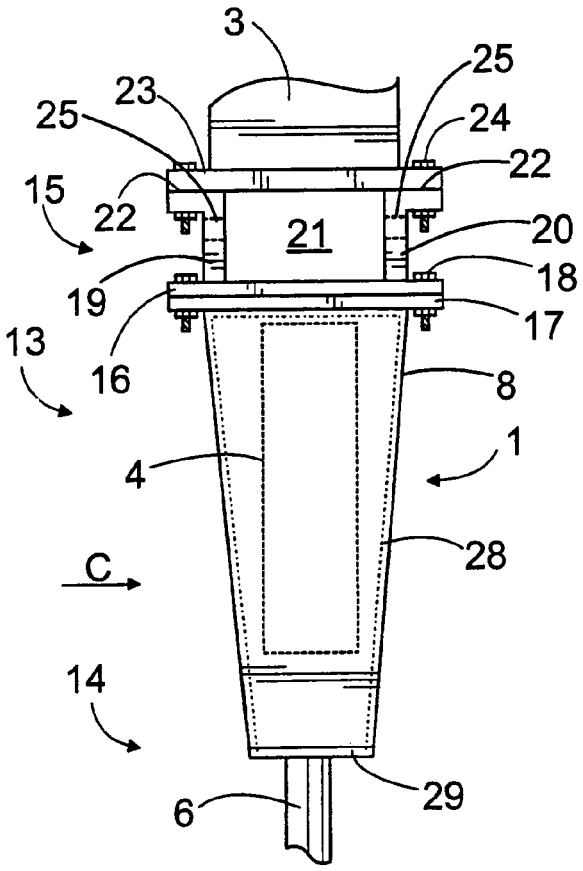
FIG. 2 is a schematic view from direction B of a breaking hammer of the invention that is fastened to a boom by means of a separate fastening element.

The breaking hammer 1 shown in FIG. 2 is an elongated piece having a top end 13 and a bottom end 14, i.e. the tool 6 side end. The breaking hammer 1 is fastened to the boom 3 or the like at its top end 13. The breaking hammer 1 may be fastened by means of a separate fastening element 15. The fastening element 15 may have a flange 16 connectable to a flange 17 or a like surface at the top end 13 of the breaking hammer 1 by means of fastening bolts 18 or the like. The fastening element 15 can also be fastened in other ways to the breaking hammer 1. It is further possible to fasten the fastening element 15 to a mounting face at the side 8 of the breaking hammer 1 instead of the surface at the top end 13. Instead of fastening bolts 18, the locking can be done by suitable quick coupling elements, pins, or in some other manner. The fastening element 15 may have a first projection 19 and a second projection 20 arranged at a distance from each other so that there remains an open space 21 between the projections 19, 20. The top parts of the projections 19, 20 may have a plane surface 22 for fastening a fastening flange 23 by using fastening bolts 24, for instance. The boom or a fastening part attached thereto may be provided with a fastening flange 23. Instead of fastening bolts 24, it is also possible to use a suitable quick coupling element, pin or the like. Further, the projections 19, 20 have transverse openings 25 for fastening the boom 3. The fastening element 15 thus has a plane surface 22 and transverse openings 25 for fastening it to the boom 3, i.e. the fastening element 15 is equipped with two alternative fastening systems.

Figure 3:
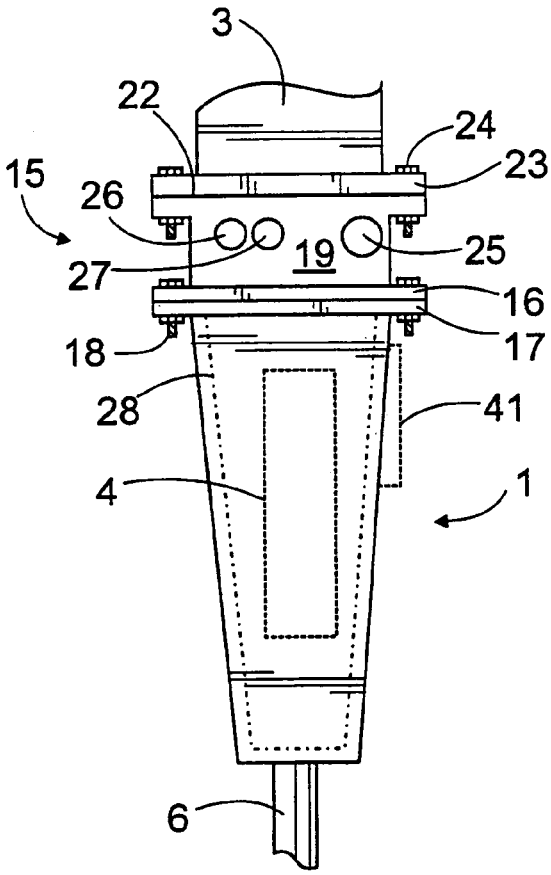
FIG. 3 is a schematic view from direction C of the breaking hammer shown in FIG. 2.

FIG. 3 shows the breaking hammer 1 of FIG. 2 from direction C. The projections 19, 20 of the fastening element 15 have two or more transverse openings. A connection pin 12 can be pushed into the first opening 25 when using pin mounting, which is an alternative to flange mounting. Further, a turning pin 11 can be arranged into a second transverse opening 26 or 27. There may be one or more of the second openings 26, 27, and they may be arranged level with each other or at different heights. By connecting the turning pin 11 to one of the second openings 26, 27, it is possible to influence the position of the breaking hammer 1 and how it moves when the turning device 10 is used. The connection pin 12 can act as a fulcrum. There may also be several first openings 25 in the fastening element 15 for the connection pin 12, if necessary.

FIGS. 2 and 3 also show that a protective casing or body, shown by dashed line 28, may surround the percussion device 4. In FIG. 2, the percussion device 4 may be taken out of the protective casing or body by opening a bottom cover piece 29 at the bottom end 14 of the breaking hammer 1. In FIG. 3, the percussion device 4 may be taken out of the protective casing or body by releasing the fastening element 15, which in this case forms a top cover piece at the top end 13 of the breaking hammer 1.

Figure 4:
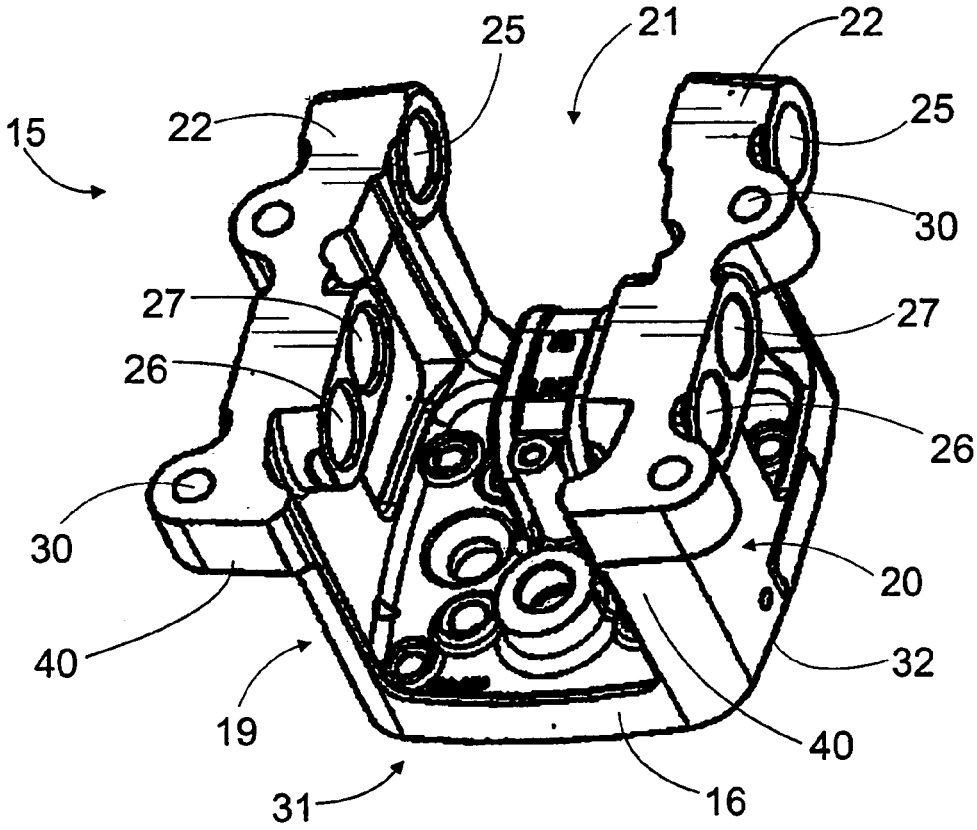
FIG. 4 is a schematic view of a fastening element of the invention.

FIG. 4 is a perspective view of a fastening element 15. The fastening element 15 may have a first projection 19 and a second projection 20 that are at a distance from each other, whereby it may have a branched structure. At the outermost parts of the projections 19, 20, there may be plane surfaces 22, against which it is possible to arrange a flange 23 on the boom 3. The projections 19, 20 may further have one or more openings 30 for fastening bolts 24 or fastening pins. The fastening element 15 may also have a body 31 with a flange 16 and a plane surface 32, against which the top end 13 of the breaking hammer 1 may be arranged. Further, the projections 19, 20 of the fastening element 15 may have transverse openings 25, 26, and 27 so that the fastening element 15 also permits pin mounting, which is an alternative to flange mounting. At the openings 25, 26, and 27, the flanges 19, 20 may have reinforcements so as to make the pin mounting firm and to allow sufficient bearing surfaces between the pins and openings. An open space 21 remains between the projections 19, 20 to permit arranging the end of the boom 3 between the projections 19, 20 for pin mounting.

Figure 5:
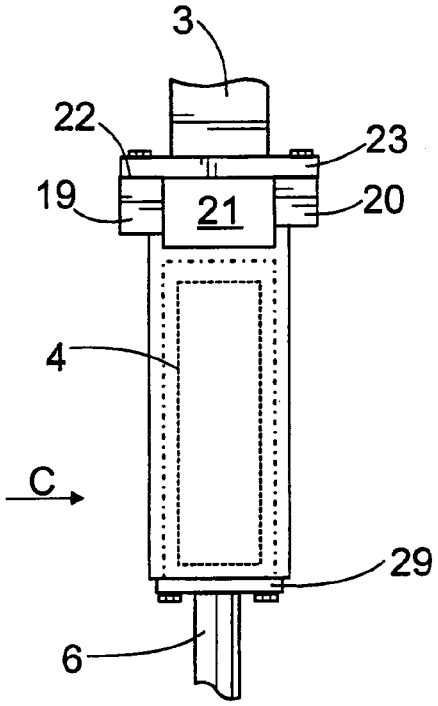
FIG. 5 is a schematic view from direction B of a breaking hammer with fastening elements of the invention formed in its protective casing or body.
Figure 6:
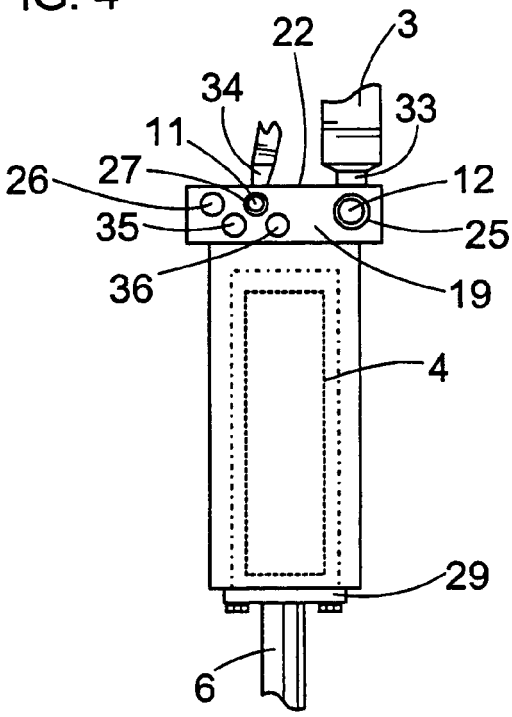
FIG. 6 is a schematic view from direction C of the breaking hammer shown in FIG. 5.

The embodiment shown in FIG. 5 does not have a separate fastening element 15, but the fastening element 7 is integrated to the structure of the protective casing or body. Projections 19 and 20 are then arranged at a distance from each other in the top part 13 of the protective casing or body. In FIG. 5, the breaking hammer 1 is fastened by flange mounting to the boom 3 or a fastening part on the boom 3. In FIG. 6, the breaking hammer 1 of FIG. 5 is fastened by pin mounting to the boom 3. At the end of the boom 3, there is a fastening part 33 that may have an opening. The fastening part 33 is pushed into the open space 21 in the top part 13 of the breaking hammer 1 so that the first opening 25 in the fastening element 7 and the opening in the fastening part 33 of the boom 3 coincide, after which a connection pin 12 is pushed through the openings to join the end of the boom 3 and the breaking hammer 1 together. The end of the boom 3 may further have turning equipment and a connecting head 34 belonging thereto can be arranged into the open space so that an opening in the connecting head 34 coincides with one of the second openings 26, 27, 35, 26, and a turning pin 11 can be arranged through the openings. As can be seen in FIG. 6, the second openings 26, 27, 35, 36 may be located at least at two different heights.

Figure 7:
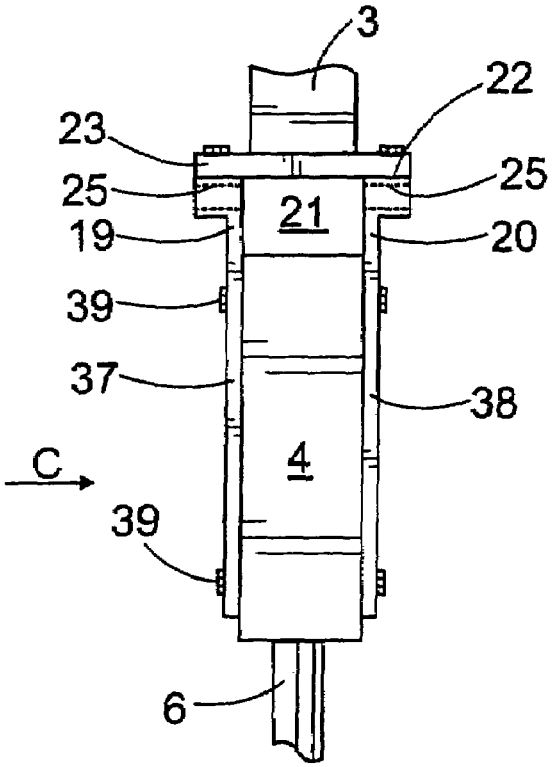
FIG. 7 is a schematic view from direction B of a breaking hammer with side plates equipped with fastening means of the invention.
Figure 8:
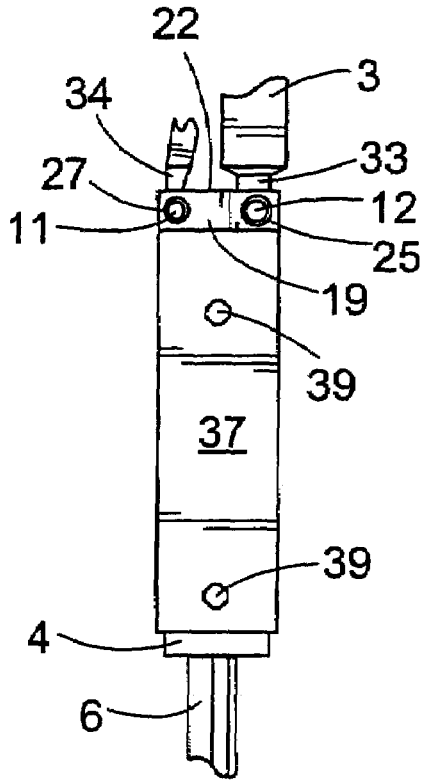
FIG. 8 is a schematic view from direction C of the breaking hammer shown in FIG. 7.

In the embodiment shown in FIGS. 7 and 8, the breaking hammer 1 is arranged between a first side plate 37 and a second side plate 38. The side plates 37, 38 may be fastened with bolts 39, pins or the like either directly against the sides of the percussion device 4 body or alternatively against the sides of the protective casing. The side plates 37, 38 may protect the structure of the breaking hammer 1 from damage during use. Further, on the top parts of the side plates 37, 38, there may be projections 19, 20 of the invention and at least two alternative fastening systems for fastening the breaking hammer 1 to the boom 3. The side plates 37, 38 may be equipped with a plane surface 22 that permits the flange mounting shown on FIG. 7. The side plates 37, 38 may also be equipped with openings 25 and 27 that permit the pin mounting shown on FIG. 8.

It should also be noted that, in some cases, a separate fastening element 15 might be connected to the side surface of the breaking hammer 1, as shown in FIG. 1. For this, there may be a fastening point 41 on the side surface of the upper part 13 of the body or protective casing of the breaking hammer. On the other hand, the fastening point 41 could be equipped with fastening elements 7 of the invention, in which case a separate fastening element 15 is not needed. There may be fastening points 41 on several side surfaces, whereby the breaking hammer 1 may be fastened in a variety of ways. The fastening points 41 may be equipped with different fastening systems.

In fastening the breaking hammer 1, it is also possible to apply different combinations of the solutions presented in this application. It is further remarked that instead of the boom 3, the breaking hammer 1 can be fastened to any projection, fastening part, or mounting face on the work machine.

In some cases, a fastening element 15 as shown in FIG. 4 may comprise not only one plane surface 22, but also several plane surfaces for flange mounting. Thus, the end surfaces 40 of the projections 19, 20, for instance, may be machined as plane surfaces suitable for flange mounting.

It is also possible to arrange other types of alternative fastening means to the breaking hammer than those described above. It is, therefore, not necessary to apply flange or pin mounting, but quick coupling elements, bayonet mounting, shape locking, or some other fastening system can also be used between the breaking device and work machine.

The drawings and the related description are only intended to illustrate the idea of the invention. The invention may vary in detail within the scope of the claims.

What is claimed is:

1. A crushing hammer that is an elongated piece having a top part and a bottom part and comprises: a percussion device arranged to generate impact pulses to a tool connectable to the crushing device, fastening means in the top part of the crushing hammer for fastening the crushing hammer to a work machine, wherein the fastening means include at least first and second alternative and separate fastening means for fastening the crushing hammer to a work machine, said first alternative fastening means including at least one plane surface at the top part of the crushing hammer, against which a flange belonging to the work machine is arrangeable to form a flange mounting between the crushing hammer and work machine, and said second alternative fastening means including at least one opening at the top part of the crushing hammer, to which a connecting pin is arrangeable for forming an alternative pin connection between the crushing hammer and work machine, wherein use of either of said first and second alternative and separate fastening means mutually excludes the use of the other of said fastening means for fastening the crushing hammer to the work machine.

2. A crushing hammer as claimed in claim 1, wherein the fastening means have at least one first projection and at least one second projection that are arranged at a distance from each other, the first projection and the second projection have a substantially empty space between them, the outermost parts of the projections have plane surfaces for a flange mounting between the crushing hammer and work machine, and the projections each comprise at least one first transverse opening, through which the connection pin is arrangeable for a pin mounting between the crushing hammer and work machine.

3. A crushing hammer as claimed in claim 2, wherein the connection pin and first opening are arranged to form a swivel, and the second alternative fastening means comprise at least one transverse second opening, through which a swivel pin is arrangeable, whereby a turning device belonging to the work machine is, through the swivel pin, arranged to turn the crushing device relative to the connection pin.

4. A crushing hammer as claimed in claim 1, wherein the fastening means are integrated to the structure of the crushing hammer.

5. A crushing hammer as claimed in claim 1, wherein the fastening means is a separate fastening element.

6. A crushing hammer as claimed in claim 1, wherein the crushing hammer is arranged between at least one first side plate and at least one second side plate, and the first and second alternative fastening means are formed in top parts of the side plates for fastening the crushing hammer to the work machine.

7. A fastening element for a crushing hammer, the crushing hammer comprising at least a percussion device arranged to generate impact pulses to a tool connectable to the crushing device, and the fastening element for fastening a top part of the crushing hammer to the outermost end of a boom of a work machine comprising: at least one first projection and at least one second projection arranged at a distance from each other, whereby there is a substantially empty space between the first projection and the second projection, at least one set of plane surfaces at the outermost parts of the projections, the plane surfaces forming means for a flange mounting between the crushing hammer and the work machine, at least one first transverse opening on the first projection and the second projection, whereby a connection pin is arrangeable through the openings for a pin mounting between the crushing hammer and the work machine, and further a flange against which a mounting face on the top part of the crushing hammer is arrangeable, wherein the first and second projections extend above the top part of the crushing hammer.

8. A fastening element as claimed in claim 7, wherein the first projection and the second projection both comprise at least one second transverse opening.

9. A side plate of a crushing hammer, the crushing hammer comprising at least a percussion device arranged to generate impact pulses to a tool connectable to the crushing device, and the crushing hammer being an elongated piece comprising a top part and a bottom part and several side surfaces, and the side plate being an elongated plate-like piece arrangeable against at least one side surface of the crushing hammer and comprising: at least two alternative and separate fastening means at the top part of the side plate for fastening the crushing hammer to a work machine, at least one plane surface at the top part of the side plate, against which a flange belonging to the work machine is arrangeable to form a flange mounting between the crushing hammer and work machine, and at least one opening at the top part of the side plate, to which a connection pin is arrangeable to form an alternative pin mounting between the crushing hammer and work machine, wherein use of either of said first and second alternative and separate fastening means mutually excludes the use of the other of said fastening means for fastening the crushing hammer to the work machine.

10. A protective casing of a crushing hammer, the crushing hammer comprising at least a percussion device arranged to generate impact pulses to a tool connectable to the crushing device, and the protective casing being arranged to define a space to which the percussion device is arrangeable the protective casing comprising: at least alternative and separate fastening means, with which it is fastenable to the work machine, at least one plane surface, against which a flange belonging to the work machine is arrangeable to form a flange mounting between the crushing hammer and work machine, and at least one opening, to which a connection pin is arrangeable to form an alternative pin mounting between the crushing hammer and work machine, wherein use of either of said first and second alternative and separate fastening means mutually excludes the use of the other of said fastening means for fastening the crushing hammer to the work machine.

* * * * *